US007506686B2

(12) United States Patent
Szarka

(10) Patent No.: US 7,506,686 B2
(45) Date of Patent: Mar. 24, 2009

(54) DIVERTER PLUGS FOR USE IN WELL BORES AND ASSOCIATED METHODS OF USE

(75) Inventor: David D. Szarka, Duncan, OK (US)

(73) Assignee: Halliburton Energy Services, Inc., Duncan, OK (US)

( * ) Notice: Subject to any disclaimer, the term of this patent is extended or adjusted under 35 U.S.C. 154(b) by 95 days.

(21) Appl. No.: 11/263,729

(22) Filed: Nov. 1, 2005

(65) Prior Publication Data

US 2007/0095527 A1 May 3, 2007

(51) Int. Cl.
*E21B 33/12* (2006.01)
*E21B 43/26* (2006.01)

(52) U.S. Cl. ..... 166/192; 166/386

(58) Field of Classification Search ..... 166/179, 166/156, 192, 313, 386, 387, 114–116, 203, 166/195, 193, 255.1, 250.04, 250.08, 250.13, 166/250.14; 277/323, 322, 336; 138/89, 138/90

See application file for complete search history.

(56) References Cited

U.S. PATENT DOCUMENTS 2,164,195 A * 6/1939 Waltermire ..... 73/40.5 R
2,627,314 A * 2/1953 Baker et al. ..... 166/156
2,856,002 A * 10/1958 True et al. ..... 166/114
2,913,054 A * 11/1959 Falk ..... 166/320
3,050,121 A * 8/1962 Garrett et al. ..... 166/285
3,065,794 A * 11/1962 Page ..... 166/125
3,091,294 A * 5/1963 Evans et al. ..... 166/135
3,104,707 A * 9/1963 Overly ..... 166/301
3,111,988 A 11/1963 Davis et al. ..... 166/42
3,289,762 A 12/1966 Schell et al.
3,314,479 A * 4/1967 McCullough et al. ..... 166/63

(Continued)

FOREIGN PATENT DOCUMENTS

EP 0697496 2/1996

(Continued)

OTHER PUBLICATIONS

Foreign communication related to a counterpart application dated Feb. 12, 2007.

(Continued)

*Primary Examiner*—Kenneth Thompson
(74) *Attorney, Agent, or Firm*—John W. Wustenberg; Baker Botts, L.L.P.

(57) ABSTRACT

Zonal isolation of well bores is often desirable for performing downhole operations such as stimulation operations. In certain embodiments, diverter plugs for achieving zonal isolation in a casing string in a well bore may comprise a mandrel having a first end and a second end; a compressible body attached to and surrounding a longitudinal portion of the mandrel; and a sealing nose attached to the first end of the mandrel. In certain embodiments, systems for achieving zonal isolation of a casing string in a well bore may comprise a diverter plug comprising a mandrel having a first end and a second end, a compressible body attached to and surrounding a longitudinal portion of the mandrel, and a sealing nose attached to the first end of the mandrel; and a landing collar sized to mate with a portion of the sealing nose of the diverter plug. Associated methods are also provided.

10 Claims, 2 Drawing Sheets

U.S. PATENT DOCUMENTS

| | | | | |
|---|---|---|---|---|
| 3,653,435 | A | 4/1972 | Reistle et al. | 166/366 |
| 4,044,827 | A | 8/1977 | Kerzee et al. | |
| 4,069,535 | A | 1/1978 | Cato | 15/104.061 |
| 4,083,076 | A | 4/1978 | Girard | 15/140.061 |
| 4,083,406 | A | 4/1978 | Metz | 166/286 |
| 4,345,402 | A | 8/1982 | Hanson et al. | 446/430 |
| 4,378,838 | A | 4/1983 | Ogden et al. | 166/153 |
| 4,499,951 | A | 2/1985 | Vann | 166/297 |
| 4,509,222 | A | 4/1985 | Knapp | 15/104.061 |
| 4,512,398 | A | 4/1985 | Hazel | 166/70 |
| 4,531,583 | A | 7/1985 | Revett | 166/277 |
| 4,545,434 | A | 10/1985 | Higgins | 166/217 |
| 4,633,946 | A | 1/1987 | Jackson | 166/187 |
| 4,674,573 | A | 6/1987 | Bode | 166/291 |
| 4,797,239 | A | 1/1989 | Cho | 264/45.5 |
| 4,836,279 | A | 6/1989 | Freeman | 166/153 |
| 4,862,966 | A | 9/1989 | Lindsey et al. | 166/382 |
| 4,907,649 | A | 3/1990 | Bode | 166/70 |
| 5,036,922 | A | 8/1991 | Braddick | 166/383 |
| 5,234,052 | A | 8/1993 | Coone et al. | 166/155 |
| 5,311,940 | A | 5/1994 | LaFleur | 166/152 |
| 5,398,763 | A | 3/1995 | Watson et al. | |
| 5,432,270 | A | 7/1995 | Zasloff et al. | 536/23.5 |
| 5,433,270 | A | 7/1995 | LaFleur | 166/152 |
| 5,435,386 | A | 7/1995 | LaFleur | 166/156 |
| 5,443,124 | A | 8/1995 | Wood et al. | 166/374 |
| 5,497,829 | A | 3/1996 | Rajkovich | 166/285 |
| 5,829,523 | A | 11/1998 | North | 166/250.14 |
| 5,928,049 | A | 7/1999 | Hudson | 446/4 |
| 5,979,557 | A | 11/1999 | Card et al. | 166/300 |
| 6,196,311 | B1 | 3/2001 | Treece | 166/192 |
| 6,725,917 | B2 | 4/2004 | Metcalfe | 166/153 |
| 6,880,636 | B2 | 4/2005 | Rogers et al. | 166/290 |
| 6,951,246 | B2 | 10/2005 | Tessier et al. | 166/153 |
| 6,973,966 | B2 | 12/2005 | Szarka | 166/153 |
| 2002/0100590 | A1 | 8/2002 | De Almeida | 166/339 |
| 2005/0103493 | A1 | 5/2005 | Stevens et al. | |
| 2005/0103504 | A1* | 5/2005 | Szarka | 166/386 |
| 2007/0095538 | A1 | 5/2007 | Szarka et al. | 166/308.1 |

FOREIGN PATENT DOCUMENTS

| | | |
|---|---|---|
| EP | 1126131 A1 | 8/2001 |
| GB | WO2005052312 | 6/2005 |
| GB | WO2005052316 | 6/2005 |
| GB | WO2007051969 | 5/2007 |
| GB | WO2007051970 | 5/2007 |
| SU | 1439264 | 11/1988 |
| SU | 1548469 | 3/1990 |

OTHER PUBLICATIONS

Brochure Entitled "Landing Nipples and Lock Mandrels," from Otis Engineering Corp., General Sales Catalog, 1980.
Halliburton Casing Sales Manual, Section 4, Cementing Plugs, pp. 4.9-3 and 4.9-5, Apr. 2005.
Halliburton Casing Sales Manual, Section 5, Multiple Stage Cementing Equipment, pp. 5.5-7, May 2004.
Halliburton Casing Sales manual, Section 4.14, "SSR Plug Releasing Darts" Jul. 2003.
Foreign Communication from a Related Counterpart Application, Feb. 2, 2005.
Office Action from U.S. Appl. No. 10/714,832—Notice of Allowance, Oct. 12, 2005.
Office Action from U.S. Appl. No. 10/714,832, May 19, 2005.
Final Office Action from U.S. Appl. No. 10/714,831, Jun. 5, 2006.
Office Action from U.S. Appl. No. 10/714,831, Dec. 30, 2005.
Final Office Action from U.S. Appl. No. 11/263,730, Oct. 22, 2007.
Office Action from U.S. Appl. No. 11/263,730, May 18, 2007.
U.S. Appl. No. 11/260.455, Jan. 6, 2007.
U.S. Appl. No. 11/615,180, Jan. 6, 2007.
Foreign communication, May 2, 2007.
Foreign communication, Feb. 14, 2007.

* cited by examiner

DIVERTER PLUGS FOR USE IN WELL BORES AND ASSOCIATED METHODS OF USE

CROSS-REFERENCE TO RELATED APPLICATION

This application is related to U.S. patent application Ser. No. 11/263,730, entitled "Diverter Plugs for Use in Well Bores and Associated Methods of Use," filed on the same day, the entirety of which is herein incorporated by reference.

BACKGROUND

The present invention relates to devices and methods for zonal isolation of well bores. More particularly, the present invention relates to zonal isolation devices and methods of use for performing multiple stage downhole stimulation operations.

Downhole production stimulation operations include operations such as hydraulic fracturing operations and acid stimulation operations. Hydraulic fracturing operations generally involve pumping a treatment fluid (e.g., a fracturing fluid) into a well bore that penetrates a subterranean formation at a sufficient hydraulic pressure to create or enhance one or more cracks, or "fractures," in the subterranean formation. Once at least one fracture is created and the proppant particulates are substantially in place, the fracturing fluid may be "broken" (i.e., the viscosity of the fluid is reduced), and the fracturing fluid may be recovered from the formation. Other production stimulation operations include acidizing treatments in which an acid is introduced into the subterranean formation to create or enhance channels or pores in the subterranean formation so as to increase the permeability of the formation.

In typical stimulation operations of subterranean formations, stimulation treatments may be independently performed in multiple stages by introducing stimulation treatments separately as to different zones along a well bore or well bores. These multiple stage treatments may be performed simultaneously, but often, it is advantageous to perform the multiple stage stimulation treatments independently and/or sequentially. Often, it is desirable to individually isolate each portion of the subterranean formation to be treated so that a stimulation treatment fluid may be introduced into a desired portion of the subterranean formation. In such multiple fracturing treatments, zonal isolation may be necessary, at least temporarily, to direct or bias the stimulation fluid into a desired portion of the subterranean formation. As used herein, the term "zone" simply refers to an area or region and does not imply a particular geological strata or composition.

Conventional methods for isolating zones or portions of subterranean zones include methods such as the ball and baffle method. In this conventional method, a series of baffles may be placed in the casing string, with each baffle being placed at a point in the string corresponding to the base of a zone or interval to be perforated and stimulated. The baffles may be arranged in order of decreasing inner diameter, with the smallest inner diameter baffle located at the base of the second lowermost zone to be stimulated. In this way, after the casing string is cemented in the well bore, the lowermost zone may be perforated to allow a stimulation treatment to be applied to the lowermost isolated zone. After completion of the stimulation treatment of the lowermost stage, the stimulation fluid may be recovered and the zone above the lowermost baffle may be perforated in preparation for a later stimulation operation. Then, a weighted ball may be introduced into the casing string that is sized to seat on the lowermost baffle. Because the baffles are usually arranged in order of decreasing inner diameter, the weighted ball may pass through all of the upper baffles, finally seating on the lowermost baffle. That is, the weighted ball may be small enough to pass through all of the upper baffles having larger inner diameters, yet be large enough to seat on the lowermost baffle, providing fluid isolation beyond the lowermost baffle. Then, once the zone below the ball and baffle is isolated from fluid communication with the zone above the ball and baffle, the zone above the ball and baffle may then be stimulated. The zonal isolation between the two zones allows the zone above the baffle to be stimulated while not being affected by possible fluid loss to the first stimulated zone. After this second stimulation treatment, the stimulation fluid may be recovered along with the weighted ball.

Subsequently, the next higher zone of interest may perforated to allow treatment of the next stage or zone with a stimulation treatment, such as a fracturing fluid or an acidizing treatment fluid. Another weighted ball sized to fit the next larger baffle may be introduced into the casing string to provide zonal isolation of the next higher zone of interest. Similarly, subsequent zones may be treated in a like manner until all zones isolated by the baffles are stimulated, after which the baffles may be drilled up if desired and the well cleaned up in preparation for production.

Conventional ball and baffle methods are often used in wells that are generally vertical, relatively cool (e.g., less than about 200° F.), and where the hydraulic pressure required for the various stages of fracturing is generally less than about 4,000 psi. Unfortunately, the ball and baffle method is limited to casing strings comprised of API threaded and coupled casings. Moreover, such methods may be difficult to carry out in wells that are either deviated wells, high temperature wells, or wells in which the fracturing pressure require high pressures. One reason that such methods may be unsuitable for deviated well bores is because the ball and baffle method relies on the free-falling of the weighted ball through the series of baffles, and the weighted ball may experience difficulty in passing through one or more of the baffles because of the non-vertical trajectory associated with a deviated well bore. Additionally, because the material of the weighted ball is often made of a drillable material, weighted balls are generally not capable of withstanding the high temperatures and pressure of certain wells without physically deforming. Further, another common disadvantage of ball and baffle methods is that the recovery of the weighted balls relies on the ability of the flow of the recovered stimulation fluid to carry the weighted ball back out of the well bore during recovery of the stimulation fluid. In some systems, the flow rate of the fluid being recovered is not sufficient to return the ball to the surface, which results in the necessity of drilling the weighted ball out of the casing string, which is undesirable because it adds additional undesirable complexity, cost, and time to the downhole operations.

Another conventional method of providing zonal isolation involves the use "frac plugs," which are sometimes referred to as "bridge plugs." In this method, frac plugs may be set at the base of each zone to be stimulated. This method, however, may require an undesirable amount of time and expense, because each frac plug has to be run and set with an individual trip into the well bore with an electric line or tubing. In situations where a drilling operator drills a number of multiple wells successively, the additional trip time for the placement of each frac plug can become quite onerous and expensive. Additionally, after completing the stimulation of all of each zone, each of the frac plugs must be drilled up to put all of the zones in production. Furthermore, the time required to complete all zones using this conventional method may be excessive, in some instances taking up to several days to complete.

SUMMARY

The present invention relates to devices and methods for zonal isolation of well bores. More particularly, the present invention relates to zonal isolation devices and methods of use for performing multiple stage downhole stimulation operations.

One example of a diverter plug for achieving zonal isolation in a casing string in a well bore comprises: a mandrel having a first end and a second end; a compressible body attached to and surrounding a longitudinal portion of the mandrel; and a sealing nose attached to the first end of the mandrel.

One example of a system for achieving zonal isolation of a casing string in a well bore comprises: a diverter plug comprising a mandrel having a first end and a second end, a compressible body attached to and surrounding a longitudinal portion of the mandrel, and a sealing nose attached to the first end of the mandrel; and a landing collar sized to mate with a portion of the sealing nose of the diverter plug.

The features and advantages of the present invention will be readily apparent to those skilled in the art. While numerous changes may be made by those skilled in the art, such changes are within the spirit of the invention.

BRIEF DESCRIPTION OF THE DRAWINGS

These drawings illustrate certain aspects of some of the embodiments of the present invention, and should not be used to limit or define the invention.

DESCRIPTION OF PREFERRED EMBODIMENTS

The present invention relates to devices and methods for zonal isolation of well bores. More particularly, the present invention relates to zonal isolation devices and methods of use for performing multiple stage downhole stimulation operations.

Multiple stage downhole treatment operations often require isolation of well bore zones to allow for the independent and/or sequential treatment of different zones of a well bore. The devices and methods of the present invention allow for enhanced isolation of portions of well bores including, but not limited to deviated well bores and gas well bores. Even though the methods of the present invention may be discussed in the context of certain types of downhole operations such as stimulation operations, the present invention is not limited to such use, but may be implemented in any downhole treatment operation in which multiple zone isolation of a well bore is desired. Devices and methods of the present invention may, in certain embodiments, be more suitable than conventional methods for zone isolation of wells having high temperatures, high pressures and/or wells that are deviated, highly deviated, or horizontal, although the present invention is expressly contemplated for use in low temperature, low pressure, and/or substantially vertical wells as well.

In certain embodiments of the present invention, a diverter plug may be used in conjunction with a landing collar to provide zonal isolation of a well bore. In certain embodiments, diverter plugs of the present invention may comprise a mandrel having a first end and a second end; a compressible body attached to and surrounding a longitudinal portion of the mandrel; and a sealing nose attached to the first end of the mandrel.

Generally, methods of the present invention provide that a landing collar may be placed in a well bore wherein the landing collar is adapted to receive a diverter plug. By placing the diverter plug in the well bore and allowing the diverter plug to mate or seat upon an intended landing collar in the well bore to form a sealing surface, the diverter plug may provide zonal isolation of the well bore so as to hinder or interrupt the fluid communication at the point where the diverter plug mates with the landing collar. As used herein, the terms, "sealing surface," "zonal isolation," and "mating" do not require total fluid isolation upon the interacting of the diverter plug and the landing collar, and these terms explicitly include a degree of sealing that results in substantial hindering or interrupting of fluid communication.

Figure 1:
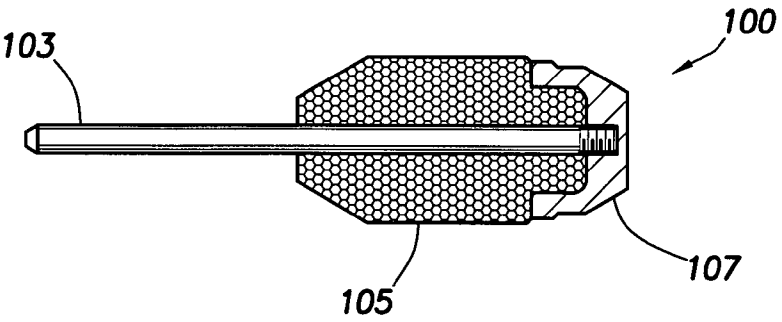
FIG. 1 illustrates an embodiment of a zonal isolation plug incorporating certain aspects of the present invention.

An exemplary embodiment of diverter plug of the present invention is depicted in FIG. 1. Diverter plug 100 comprises mandrel 103, compressible body 105, and sealing nose 107.

In certain embodiments, mandrel 103 may be a longitudinal member having sufficient mechanical integrity on to which components may be attached such as compressible body 105 and sealing nose 107. Although FIG. 1 shows mandrel 103 as having a substantially cylindrical shape, other shapes suitable to allow attachment of ancillary components may be used. In certain exemplary embodiments, mandrel 103 may have the shape of a column with a circular cross-section. In other embodiments, the outer shape of mandrel 103 may comprise one or more ribs, or have an otherwise varying outer circumference along its length, such that compressible body 105 may be adequately engaged to mandrel 103 for a given application. Mandrel 103 may be constructed from any material suitable for use in the subterranean environment in which the present invention will be used. Examples of suitable materials include, but are not limited to, any metal, composite materials, steels including stainless steel and mild steel, aluminum, bronze, brass, or combinations thereof.

Compressible body 105 may be attached to a longitudinal portion of mandrel 103. Compressible body 105 may be composed of any compressible and/or elastic material suitable for use in an intended subterranean environment such as, for example, foamable elastomers. Examples of suitable materials for compressible body 105 include, but are not limited to, open-cell foams comprising natural rubber, nitrile rubber, styrene butadiene rubber, polyurethane, or combinations thereof. Any open-cell foam having a sufficient density, firmness, and resilience may be suitable for the desired application. One of ordinary skill in the art with the benefit of this disclosure will be able to determine the appropriate construction material for compressible body 105 given the compression and strength requirements of a given application. In certain exemplary embodiments of the present invention, compressible body 105 comprises an open-cell, low-density foam.

Generally, compressible body 105 should be sized to create an interference fit with the inner diameter of the casing string. In certain embodiments, the overall length of compressible body 105 is about 1.25 to about 1.5 times the inner diameter of the casing string. In certain embodiments, compressible body 105 may compress readily to pass through relatively small diameter restrictions without requiring excessive differential pressure to push diverter plug 100 to the desired location. By forming an interference fit with the largest diameter through which diverter plug 100 is intended to pass, diverter plug 100 may be capable of being positively displaced by a fluid so as to place diverter plug 100 at a desired location or to allow retrieval of diverter plug 100 by positive displacement by a displacement fluid or a reservoir fluid. It is understood that the fluid providing positive displacement motive for transport of diverter plug 100 may be a liquid, a gas, or combination thereof. Additionally, the fluid displacing the diverter plug may be a reservoir fluid, a displacement fluid introduced into the well bore, or a combination thereof.

In certain exemplary embodiments of the present invention, compressible body 105 has a substantially cylindrical shape. In certain embodiments, the leading edge of compressible body 105 may be tapered and/or have a constant cross-section, although it is recognized that the outer surface of compressible body 105 may have a variable cross-section. Generally, the outside diameter of compressible body 105 may exceed the outside diameter of sealing nose 107. Compressible body 105 may be molded around and bonded to mandrel 103. Any bonding method known in the art may be used to bond or attach compressible body 105 to mandrel 103. In certain embodiments, mandrel 103 may not extend beyond compressible body 105. In the embodiment depicted here, however, compressible body 105 is shown as not encompassing the entire length of mandrel 103. In this way, the end of mandrel 103 opposite to sealing nose 107 may be adapted to function as a fishing neck or a retrievable member to which mechanical retrieval tools may attach if necessary. Examples of suitable mechanical retrieval tools known in the art include overshots deployed either on wire line or tubing (e.g., jointed or coiled) that are known in the art.

Figure 2:
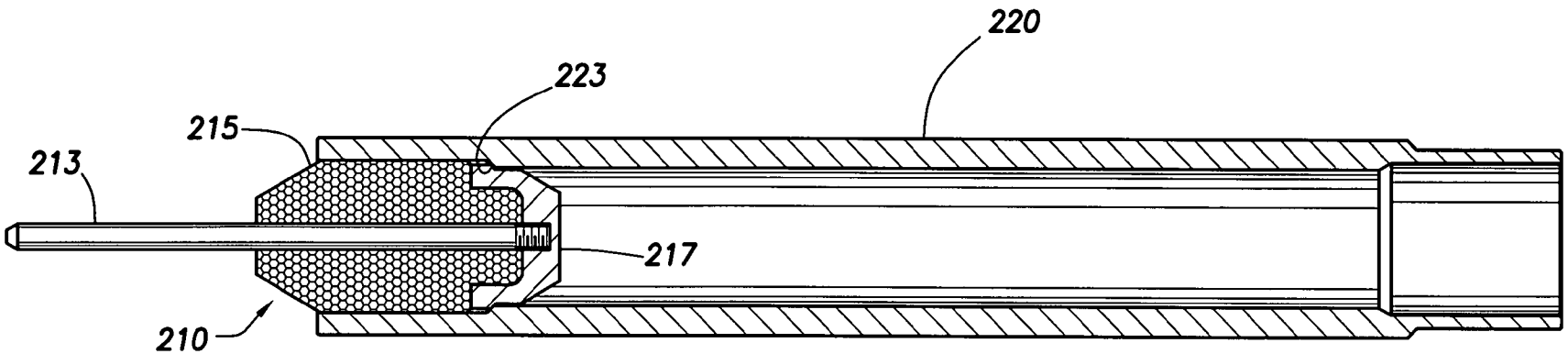
FIG. 2 illustrates an embodiment of a zonal isolation plug interacting with a baffle collar.

Sealing nose 107 may be attached to mandrel 103. Sealing nose 107 may be constructed from any material suitable for use in the subterranean environment in which the present invention will be used. Examples of suitable materials include, but are not limited to, any metal, composite materials, steels including stainless steel and mild steel, aluminum, bronze, brass, or combinations thereof. When selecting a material suitable for sealing nose 107, a material should be chosen so as to withstand the differential pressures to which sealing nose 107 will be subjected. Sealing nose 107 may attach to mandrel 103 via a threaded connection, welding, or any suitable attachment method known in the art. Whereas sealing nose 107 and mandrel 103 are depicted in FIG. 2 as two separate members joined together, it is recognized that sealing nose 107 and mandrel 103 could be formed as one contiguous piece. Generally, sealing nose 107 may have a seating profile adapted to seat upon a corresponding seating profile of a landing collar to form a sealing surface sufficient to provide zonal isolation. In certain exemplary embodiments, sealing nose 107 may be a self-guiding or self-centralizing nose to aid its passage through successive well bore restrictions.

FIG. 2 illustrates the interaction of diverter plug 210 with landing collar 220. Generally, landing collar 220 may be used to provide seating profile 223 upon which diverter plug 210 may seat, land, or mate. In certain embodiments, landing collar 220 may be adapted to have seating profile 223 designed to mate with a seating surface of sealing nose 217. A person of ordinary skill in the art with the benefit of this disclosure will recognize that a variety of corresponding shapes could be used for sealing nose 217 and the corresponding seating profile of landing collar 220 so as to form a sealing surface. The seal between sealing nose 217 and seating profile 223 may be a metal-to-metal seal in certain embodiments. Indeed, seating profile 223 may be formed simply by way of an inner diameter restriction in the casing string so as to provide a capturing point for diverter plug 210. In certain exemplary embodiments, sealing nose 217 may further comprise elastomeric o-rings to aid the sealing between sealing nose 217 and seating profile 223. By forming a sealing surface between sealing nose 217 and seating profile 223, the sealing surface provides zonal isolation so as to hinder the communication of fluid from one side of the sealing surface to the other side of the sealing surface.

Landing collar 220 may be formed of any material sufficient to withstand the conditions of the intended well bore environment. Typically, landing collar 220 may be made of the same material having the same mechanical properties as the parent casing string. Examples of suitable materials include, but are not limited to, any metal, composite materials, steels including stainless steel and mild steel, or a combination thereof. In certain embodiments, it may be preferred that landing collar 220 be made of a nondrillable material. In embodiments where landing collar 220 is partially made of a drillable material, such as where a drillable insert forms part of an inner portion of landing collar 220, the outer portion of landing collar 220 may be of any material generally compatible in mechanical properties as the parent casing string.

Figure 3:
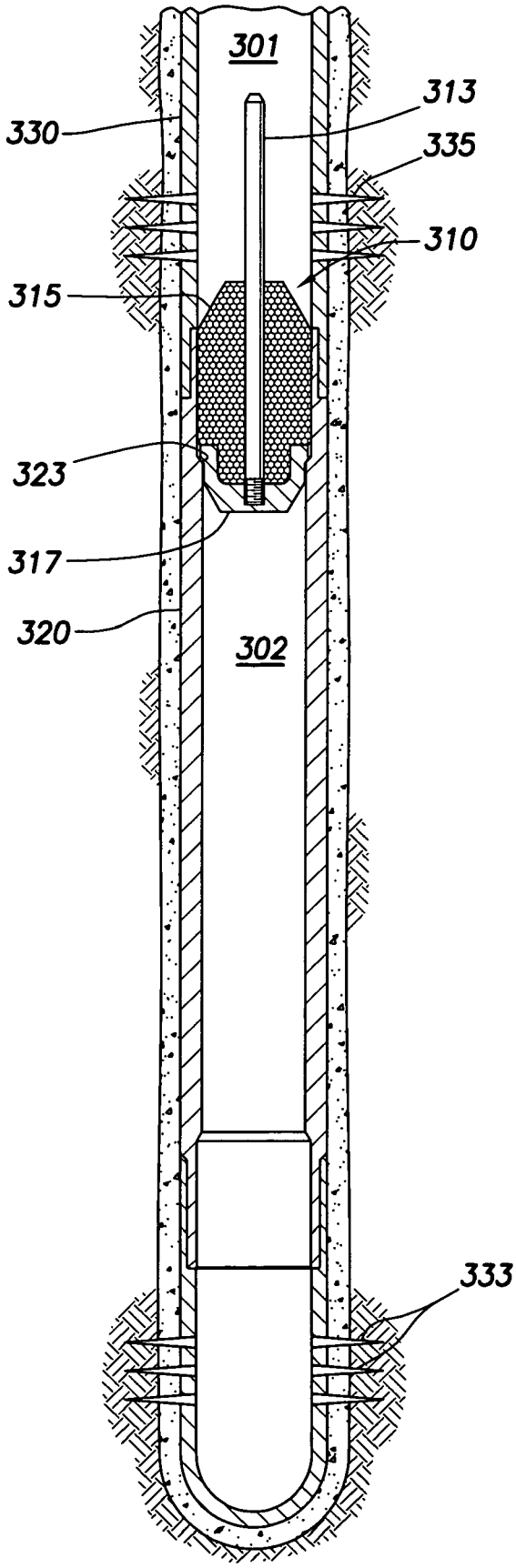
FIG. 3 illustrates one implementation of a zonal isolation system in a well bore casing string.

FIG. 3 illustrates one implementation of a zonal isolation system in a well bore casing string. The preferred method of installing landing collar 320 in casing string 330 is by preinstallation of landing collar 320 as the casing string is made up and run into the well bore. When diverter plug 310 seats upon or mates with landing collar 320 to form a sealing surface, well bore zone 301 may be fluidly isolated from well bore zone 302. Treatment operations may be conducted in well bore 302 without materially affecting well bore zone 301.

In one embodiment, the present invention provides a method comprising the steps of: providing a diverter plug, the diverter plug comprising a mandrel having a first end and a second end, a compressible body surrounding a longitudinal portion of the mandrel, and a sealing nose attached to the first end of the mandrel; providing a casing string in a well bore; providing a landing collar attached to a portion of the casing string, the landing collar having a seating profile capable of mating with the sealing nose of the diverter plug; introducing the diverter plug into the casing string; and displacing the diverter plug down the casing string with a fluid so as to allow the sealing nose of the diverter plug to contact a portion of the landing collar so as to form a sealing surface and provide zonal isolation.

Additionally, in some embodiments, multiple landing collars of successively decreasing inner diameters may be used in a casing string to provide multiple zonal isolation points along a casing string, for example, like casing string 330 (FIG. 3). In such a system, the landing collar with the smallest inner diameter restriction would be placed at the lowermost portion of the casing in which zonal isolation is desired, with the next largest restriction being placed at the next higher desired isolation point above the lowermost landing collar, and so on. In this way, landing collars may be placed in the casing string in order of successively decreasing inner diameter restrictions, with each landing collar being placed at a desired location of zonal isolation. Diverter plugs adapted to mate with each installed landing collar would be fabricated to mate with each of the corresponding landing collars. Thus, each landing collar has associated with it a corresponding diverter plug designed to mate with that particular landing collar. Because the landing collars are arranged in order of successively decreasing inner diameter restrictions, a particular diverter plug may pass through multiple landing collars until finally seating upon its corresponding landing collar.

In certain embodiments, systems having multiple landing collars may decrease in inner diameter restriction at least about ¼" per successive landing collar. Additionally, in certain preferred embodiments, the uppermost landing collar may have an inner diameter restriction of at least about ¼" smaller than the inner diameter of the casing string. Likewise, each corresponding diverter plug may have a sealing nose with a diameter of about ⅛" difference with each corresponding landing collar so as to provide sufficient interference to permit the diverter plug to land, mate, or seat upon its corresponding landing collar. Thus, in certain embodiments, each successive sealing nose may decrease in inner diameter at least about ¼" for each successively smaller diverter plug. In certain embodiments, where the landing collar is of the non-drillable type, it may be preferred to minimize the flow restriction provided by each landing collar so as to minimize flow friction losses during subsequent production of the well.

The devices and methods of the present invention may be suitable for performing multiple fracturing operations. With reference to FIG. 3 for illustration purposes only, after completion of a well bore, casing string 330 may be set and cemented in the well bore. Casing string 330 may have landing collar 320 preinstalled in casing string 330. The casing string below landing collar 320 may be perforated to form lower perforations 333. A first stimulation fluid may then be introduced into casing string 330 so as to stimulate a portion of the subterranean formation below landing collar 320 via lower perforations 333. The first stimulation fluid may then be optionally recovered if desired. Then, casing string 330 may be perforated above landing collar 320 to form upper perforations 335. Diverter plug 310 may be then introduced into casing string 330. Subsequently, a second stimulation fluid may be introduced into casing string 330 so as to stimulate a portion of the subterranean formation above landing collar 320, in this case via upper perforations 335. As the second stimulation fluid is being introduced into casing string 330, the second stimulation fluid may displace diverter plug 310 down casing string 330. In this way, the fluid may displace diverter plug 310 so as to allow the sealing nose of the diverter plug to contact seating profile 323 of landing collar 320 so as to form a sealing surface, providing zonal isolation between well bore zone 301 and well bore zone 302. If desired, the second stimulation fluid may be optionally recovered. As would be recognizable to a person of ordinary skill in the art, in certain embodiments, the second stimulation fluid may have a leading portion of the stimulation fluid being a break down fluid such as a suitable acid.

After fracturing of the second zone is completed, the diverter plug could be recovered by allowing pressure from well bore zone 301 to displace diverter plug 310 back up casing string 330. Optionally, the same process could be repeated for any landing collars that may be installed above landing collar 320 to allow zonal isolation of other sections of casing string 330 so as to perform additional stimulation operations to other well bore zones. It is recognized that in the case of gas wells, the displacing fluid providing displacement of diverter plug 310 during recovery of diverter plug 310 would be a reservoir gas or a gas cut liquid, whereas in oil wells, the reservoir fluid would be a liquid, although in certain embodiments, the displacement fluid allowing for recovery of diverter plug 310 could be a combination thereof or a displacement fluid previously introduced into the well bore.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present invention. In particular, every range of values (of the form, "from about a to about b," or, equivalently, "from approximately a to b," or, equivalently, "from approximately a-b") disclosed herein is to be understood as referring to the power set (the set of all subsets) of the respective range of values, and set forth every range encompassed within the broader range of values. Also, the terms in the claims have their plain, ordinary meaning unless otherwise explicitly and clearly defined by the patentee.

What is claimed is:

1. A diverter plug for achieving zonal isolation in a casing string in a well bore comprising:

a mandrel having a first end and a second end;

a compressible body attached to and surrounding a longitudinal portion of the mandrel; and a sealing nose attached to the first end of the mandrel;

wherein compressible body is configured to compress as it passes through restrictions;

wherein the mandrel comprises a longitudinal member;

wherein a portion of the mandrel is adapted to being used as a retrievable fishing neck for retrieving the diverter plug;

wherein a portion of the longitudinal member protrudes beyond the compressible body; and wherein the compressible body has a longitudinal length of at least about 1.25 times greater than the inner diameter of the casing string.

2. The diverter plug of claim 1 wherein the compressible body comprises an open-cell foam.

3. The diverter plug of claim 1 wherein the compressible body comprises rubber.

4. A system for achieving zonal isolation of a casing string in a well bore comprising:

a diverter plug comprising a mandrel having a first end and a second end, a compressible body attached to and surrounding a longitudinal portion of the mandrel, and a sealing nose attached to the first end of the mandrel; and a landing collar sized to mate with a portion of the sealing nose of the diverter plug;

wherein the mandrel comprises a longitudinal member;

wherein a portion of the mandrel is adapted to being used as a retrievable fishing neck for retrieving the diverter plug;

wherein a portion of the longitudinal member protrudes beyond the compressible body; and wherein the compressible body has a length of at least about 1.25 times greater than the inner diameter of the casing string.

5. The system of claim 4 wherein the compressible body comprises an open-cell foam.

6. The system of claim 4 wherein the compressible body comprises rubber.

7. The system of claim 4 wherein the compressible body comprises a compressible material sized to form an interference fit with a portion of the inner diameter of the landing collar.

8. The system of claim 4
wherein an inner portion of the landing collar comprises a drillable material.

9. The system of claim 4
wherein the landing collar comprises a seating profile capable of receiving a portion of the sealing nose so as to form a sealing surface.

10. The system of claim 5
wherein the landing collar comprises a seating profile capable of receiving a portion of the sealing nose of the diverter plug so as to form a sealing surface.

* * * * *